US005289087A

United States Patent [19]

Summey, III

[11] Patent Number: 5,289,087

[45] Date of Patent: Feb. 22, 1994

[54] SURFACE WINDER DRIVE AND METHOD

[75] Inventor: Shala W. Summey, III, Greenville, S.C.

[73] Assignee: Alexander Machinery, Inc., Mauldin, S.C.

[21] Appl. No.: 970,259

[22] Filed: Nov. 2, 1992

[51] Int. Cl.[5] ..... B65H 18/16

[52] U.S. Cl. ..... 318/7; 242/65

[58] Field of Search ..... 318/6, 7, 372; 242/54 R, 55, 189, 190, 191, 192, 196, 203, 204, 62, 63, 65, 75.4, 257, 285, 286, 296, 86.63, 86.64, 86.7, 99, 107.15, 107.3

[56] References Cited

U.S. PATENT DOCUMENTS

| | | | |
|---|---|---|---|
| 1,144,362 | 6/1915 | Smith | 242/191 |
| 1,768,939 | 7/1930 | Staege . | |
| 1,920,897 | 8/1933 | Shoults . | |
| 1,987,670 | 1/1935 | Drake et al. . | |
| 2,169,016 | 12/1937 | Baker . | |
| 2,323,741 | 7/1943 | Watson . | |
| 2,325,381 | 7/1943 | Edwards et al. . | |
| 2,353,408 | 7/1944 | Larsen . | |
| 2,430,639 | 11/1947 | Jacques . | |
| 2,498,234 | 2/1950 | Baker et al. . | |
| 2,677,870 | 5/1954 | Furst | 242/75.4 |
| 3,279,718 | 10/1966 | Arterton et al. | 242/65 |
| 3,482,800 | 12/1969 | Barnett et al. | 242/192 |
| 3,748,811 | 7/1973 | Cox . | |
| 4,097,785 | 6/1978 | Sato et al. | 318/89 |
| 4,588,931 | 5/1986 | Alexander | 318/7 |
| 4,669,686 | 6/1987 | Huber et al. | 242/204 |

*Primary Examiner*—Bentsu Ro

*Attorney, Agent, or Firm*—Ralph Bailey

[57] ABSTRACT

A batcher has a brake (E) connected to the packing roll (B) for slowing the packing roll as during an unwinding phase to vary the packing ratio between the packing roll (B) and the drive roll (A). A drive mechanism (D) utilizes a single drive clutch for imparting a free wheeling action to the packing roll during unwinding so as to facilitate operation of the brake in effecting the proper packing ratio.

10 Claims, 3 Drawing Sheets

SURFACE WINDER DRIVE AND METHOD

BACKGROUND OF THE INVENTION

This invention relates to surface winders and to an improved apparatus and method for facilitating a reverse winding operation.

Batchers and other surface winders have been provided with electronic controls such as illustrated in U. S. Pat. No. 4,588,931 to facilitate varying the packing ratio between the support rolls. The packing ratio between the respective drive rolls and packing rolls plays an important part in the building of even cloth on other web rolls whether in a forward or in a reverse direction as when unwinding. Such apparatus is expensive and prone to give problems in the hostile environment of a textile mill. The problem of reversing the direction of a surface winder such as a batcher as illustrated herein comes from the tendency of the cloth or other web to pucker or sag just ahead of the support rolls causing an undesirable build up of loose fabric. This is especially true when reversing the direction of winding in order to build a tight roll in a reverse direction. By readily and infinitely varying the packing ratio adjustments may be made to produce a smooth roll wherein sagging is avoided and a superior building operation is provided.

SUMMARY OF THE INVENTION

Accordingly, it is an important object of this invention to provide a mechanical mechanism for varying the packing ratio upon reversal of a surface winding operation.

Another important object of the invention is to provide a surface winder with a friction brake having connection to the packing roll for varying the packing ratio between the driven roll and the packing roll during a winding operation.

Still another important object of the invention is to facilitate variations in packing ratios in a surface winder upon a reversal in direction of winding by providing a friction brake attached to the packing roll and a special one-way drive to impart free wheeling during a reverse winding phase.

Another object of the invention is to provide a friction brake connection with the packing roll of a surface winder to provide infinite adjustment making it possible to adjust the packing ratio until a smooth roll and trouble free operation is achieved. The type of fabric being wound is an important factor in determining what the packing ratio must be and this can be arrived at by trial and error when setting up the operation while permitting further adjustment for optimal results.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate apparatus for driving a surface winder having a drive roll A and a packing roll B for taking up and letting off a web from a web roll wound upon a roll core. A motor C drives the drive roll for taking up a web upon the web roll. A drive D is provided for driving the packing roll. A friction brake E is connected to the packing roll for varying the packing ratio between the drive roll and the packing roll through the drive D.

Figure 1:
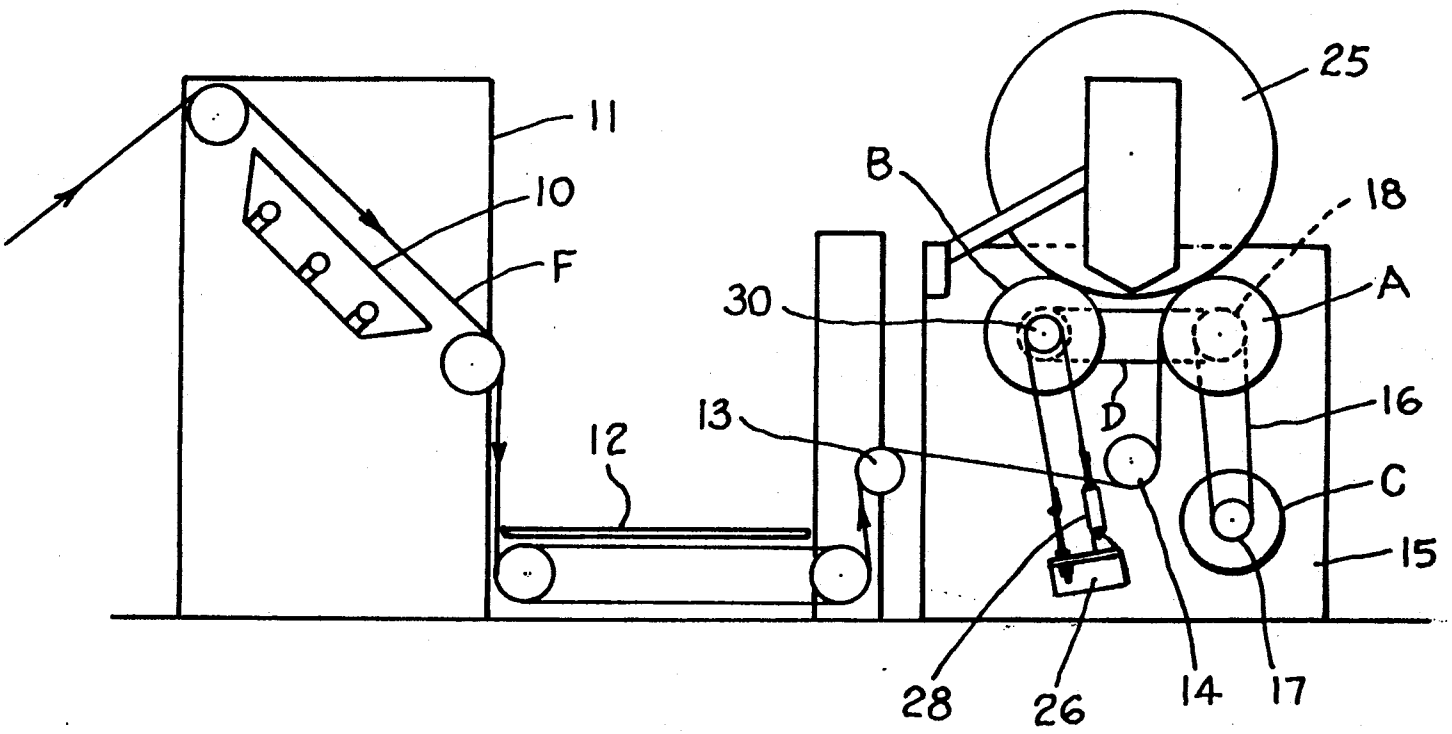
FIG. 1 is a schematic side elevation illustrating a surface wound batcher equipped with a drive constructed in accordance with the present operation as utilized with a cloth inspection device.

FIG. 1 illustrates a light table 10 of a cloth inspection machine 11 having fabric F pass thereover and downwardly beneath an operator platform 12 and thence upwardly over a direction roll 13 and then in a substantially horizontal path 14 before passing upwardly past the drive roll 18 to the cloth roll 25.

Figure 2:
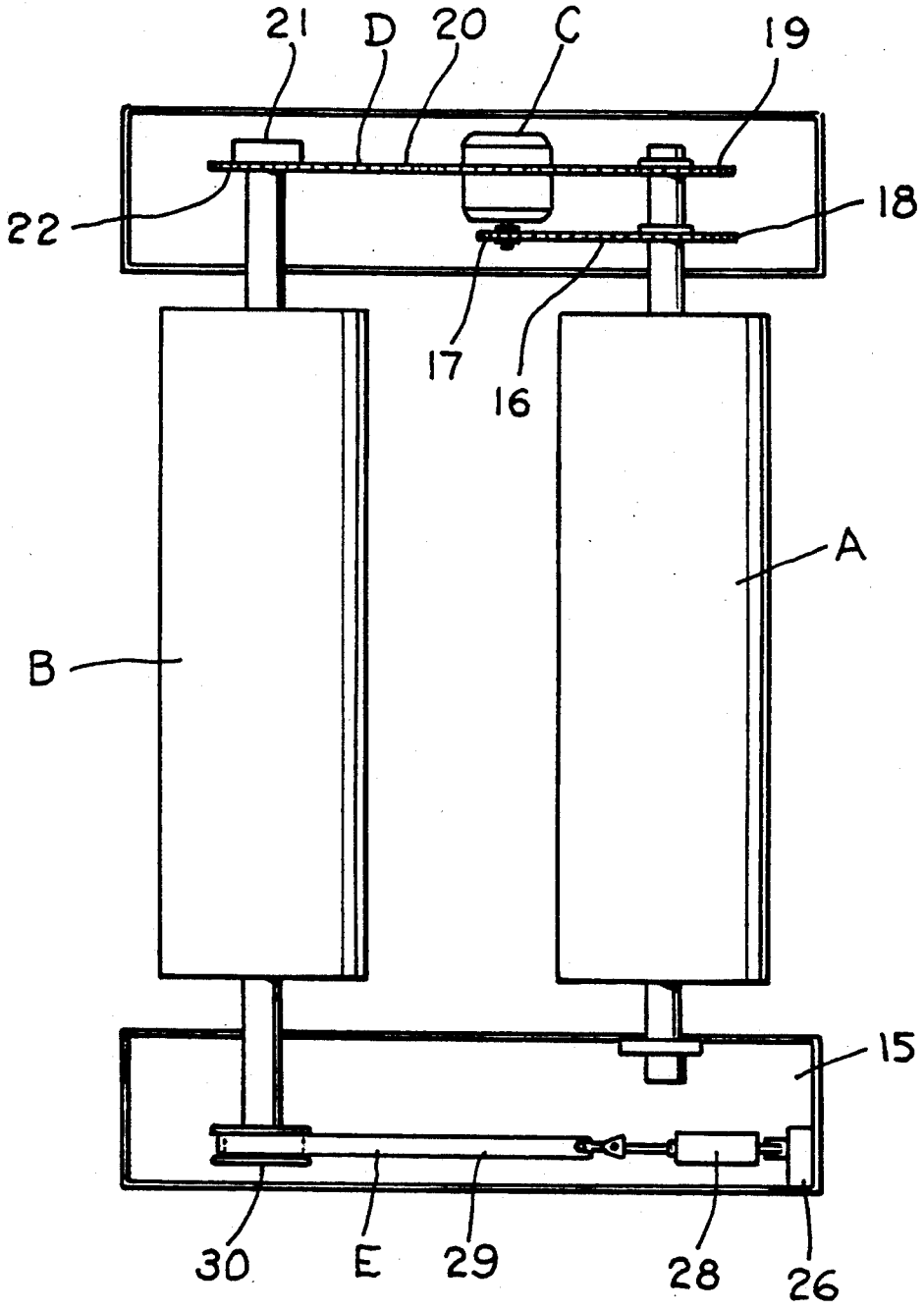
FIG. 2 is a schematic plan view further illustrating the batcher of FIG. 1.

The batcher is illustrated as including a frame member 15 for supporting the drive roll A and the packing roll B for rotation. The drive roll A is driven by a suitable chain or belt 16 from the power take off 17 to a sprocket 18. As best shown in FIG. 2, a second sprocket 19 is provided for driving a chain 20 as a part of the drive D for driving the packing roll between a Sprag single direction clutch 21. A sprocket 22 drives the roll B.

Figure 3:
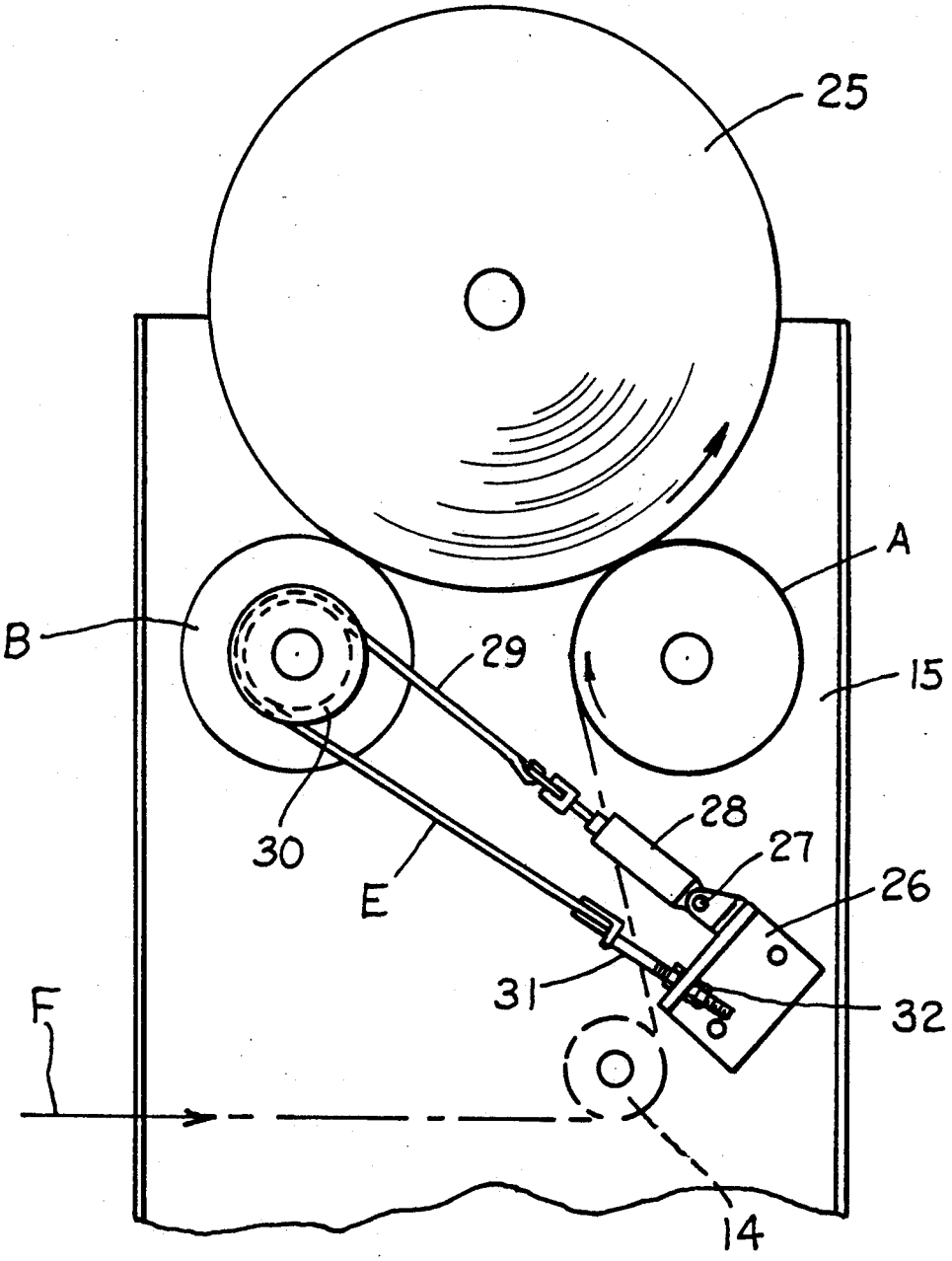
FIG. 3 is an end elevation of the batcher illustrating a friction brake and its attachment adjacent the idler end of the packing roll in accordance with the invention.

The single direction clutch 21 acts as a drive imparting free wheeling to the packing roll B during a reverse winding operation permitting the use of the friction brake E. A packing ratio causing the packing roll to turn slightly faster than the drive roll when winding in forward direction is provided when sprocket 22 has slightly less teeth than the sprocket 19. When the direction of winding is reversed the brake E effects a frictional engagement of the packing roll B to impart a negative packing ratio thereto which is permitted by the free wheeling of the packing roll B. FIGS. 1 and 2 illustrate a web roll 25 which has been built upon the surface winding support rolls A and B as illustrated in FIGS. 1 and 3. The friction belt arrangement E is best shown in FIGS. 2 and 3 wherein a bracket 26 is secured to the frame 15 and a pivotal mounting 27 is provided for an air cylinder 28 may exert a pulling and releasing action upon the belt 29 which is carried upon a brake drum 30 connected to the packing roll B.

The belt 29 has a connector 31 which is bolted as at 32 to the bracket on operation. When a predetermined build up of the web roll 25 has occurred a suitable switch mechanism is actuated responsive to the build to energize the fluid operated cylinder 28 to engage the friction brake E with packing roll B.

It is thus seen that the packing ratio will vary infinitely depending upon the frictional force exerted by the belt so that a negative or otherwise suitable packing ratio can be achieved so as to avoid uneven building of the web roll.

While a preferred embodiment of the invention has been described using specific terms, such description is for illustrative purposes only, and it is to be understood that changes and variations may be made without departing from the spirit or scope of the following claims.

What is claimed is:

1. Apparatus for driving a surface winder having a drive roll and a packing roll for taking up and letting off a web from a web roll wound upon a roll core comprising:

a motor driving said drive roll for taking up a web upon said web roll;

means driving said packing roll;

a friction brake; and means connecting said friction brake to said packing roll for varying the packing ratio between the drive roll and the packing roll.

2. The apparatus set forth in claim 1 wherein said friction brake includes a belt applying a braking action to said packing roll.

3. The apparatus set forth in claim 1 wherein said means driving said packing roll includes a chain drive between said drive roll and said packing roll.

4. The apparatus set forth in claim 3 including a clutch releasable to impart free wheeling to said packing roll when letting off a web.

5. Apparatus for driving a surface winder having a drive roll and a packing roll for taking up and letting off a web from a web roll wound upon a roll core comprising:

a motor driving said drive roll for taking up a web upon said web roll;

means driving said packing roll;

means including a friction brake varying the speed of the packing roll for varying a packing ratio between the drive roll and the packing roll; and means controlling said means varying the speed of the packing roll varying the packing ratio between the drive roll and the packing roll when letting off said web wherein the packing roll is driven at a speed less than that of the drive roll.

6. The apparatus set forth in claim 5 including a clutch releasable for imparting free wheeling to said packing roll when letting off said web.

7. The apparatus set forth in claim 6 including a single drive clutch connecting said packing roll to said drive roll.

8. A method of driving a surface winder having a drive roll and a packing roll for taking up and letting off a web from a web roll wound upon a roll core comprising the steps of:

providing a motor driving said drive roll for taking up a web upon said web roll; and means driving said packing roll from said drive roll;

applying a retrading force exerting a braking action upon the packing roll for varying a packing ratio between the drive roll and the packing roll; and controlling said braking action varying the speed of the packing roll for varying the packing ratio between the drive roll and the packing roll when letting off said web.

9. The method set forth in claim 8 including imparting free wheeling to said packing roll when letting off said web, and applying the braking action varying the speed of the packing roll through actuation of a friction brake.

10. The method set forth in claim 9 including driving the packing roll at a speed greater than that of the drive roll when taking up a web.

* * * * *